US005850901A

United States Patent [19]

Schuster et al.

[11] Patent Number: 5,850,901

[45] Date of Patent: Dec. 22, 1998

[54] SORTING INSTALLATION, IN PARTICULAR FOR MAIL

[75] Inventors: Rudolf Schuster, Kirchheim; Rudolf Brugger, Puchheim, both of Germany

[73] Assignee: Siemens Aktiengesellschaft, Munich, Germany

[21] Appl. No.: 581,521

[22] PCT Filed: Jul. 7, 1994

[86] PCT No.: PCT/DE94/00784

§ 371 Date: Feb. 15, 1996

§ 102(e) Date: Feb. 15, 1996

[87] PCT Pub. No.: WO95/02469

PCT Pub. Date: Jan. 26, 1995

[30] Foreign Application Priority Data

Jul. 14, 1993 [DE] Germany ..... 43 23 564.6

[51] Int. Cl.[6] ..... B07C 3/08

[52] U.S. Cl. ..... 198/370.05; 198/370.03

[58] Field of Search ..... 198/370.03, 370.05, 198/367.1, 704, 838, 845

[56] References Cited

U.S. PATENT DOCUMENTS

| | | | |
|---|---|---|---|
| 3,300,026 | 1/1967 | Lens et al. | 198/704 |
| 3,550,751 | 12/1970 | Jack, Jr. | 198/370.05 X |
| 3,589,498 | 6/1971 | Cowan et al. | 198/704 X |
| 3,679,045 | 7/1972 | Morgan et al. | 198/704 X |
| 4,310,276 | 1/1982 | Castognoli | 198/367.1 |
| 4,509,635 | 4/1985 | Emsley et al. | 198/704 X |
| 4,984,676 | 1/1991 | Michel | 198/704 X |
| 5,096,047 | 3/1992 | Morikiyo et al. | 198/704 |
| 5,244,078 | 9/1993 | Silva et al. | 198/370.05 X |
| 5,311,976 | 5/1994 | Backman | 198/370.05 X |

FOREIGN PATENT DOCUMENTS 2454338 3/1980 France .

*Primary Examiner*—David A. Bucci
*Attorney, Agent, or Firm*—Hill & Simpson

[57] ABSTRACT

A sorting installation, in particular for mail, comprises a plurality of conveyed item carriers, circulating on at least one conveying mechanism, for receiving, transporting and controllably delivering the conveyed items. Each conveyed item carrier has a fixedly arranged wall part and a movably arranged wall part. The movably arranged wall part forms in a closed position together with the fixedly arranged wall part a cross-sectionally U-shaped or V-shaped receiving pocket for the conveyed items. The movably arranged wall part forms in a delivery position together with the fixedly arranged wall part a downwardly open delivery slot for the conveyed items.

15 Claims, 4 Drawing Sheets

SORTING INSTALLATION, IN PARTICULAR FOR MAIL

RELATED APPLICATION

The present application is related to copending application U.S. Ser. No. 08/581,522 filed Jun. 11, 1996 entitled "SORTING INSTALLATION, IN PARTICULAR FOR MAIL", Schuster et al, inventors.

BACKGROUND OF THE INVENTION

The machine-readable postal code numbers to be given on items of mail, such as letters, postcards, parcels and the like, as a code number for a location, a delivery area, a post office box or a major recipient make it possible for the mail to be distributed at high speed by machine. The sorting of the incoming items of mail is in this case performed with the aid of controllable conveyed item carriers, which are loaded with one item of mail in each case manually or by machine at specific loading points and then deliver this item of mail to a sorting container, or a corresponding pigeonhole, assigned to the respective postal code number. Since, for reasons of saving space, there is the wish to arrange both the loading points and the sorting containers or pigeonholes on different levels, the conveyed item carriers circulating on conveying mechanisms must possibly also be able to provide a link between different heights. After the transfer of the item of mail to the assigned sorting container or the assigned pigeonhole, the empty conveyed item carrier can again be loaded with an item of mail when it passes a loading point.

U.S. Pat. No. 3,300,026 discloses a sorting installation for mail which has conveyed item carriers, circulating in pairs on a conveying mechanism, for receiving, transporting and controllably delivering the mail to sorting containers. The conveying mechanism comprises two endlessly circulating chains which are at a distance from each other, are guided in a meandering form by means of corresponding rollers and guide the conveyed item carriers on a number of levels lying one above the other, along in each case a row with sorting containers. Each of the conveyed item carriers circulating in pairs comprises a fixedly arranged wall part and a movably arranged wall part, the movably arranged wall part forming in a closed position together with the fixedly arranged wall part a cross-sectionally V-shaped receiving pocket for the mail, and the movably arranged wall part forming in a delivery position together with the fixedly arranged wall part a downwardly open delivery slot for the conveyed items.

SUMMARY OF THE INVENTION

It is an object of the invention to provide sorting installation which is of a simple construction and ensures high-speed and reliable transfer of the conveyed item to the assigned sorting container or the assigned pigeonhole. The sorting installation is at the same time to be suitable in particular also for the sorting and distributing of thin letters.

Apart from the sorting and distributing of mail in public post offices or the in-house mail centers of large companies, a sorting installation according to the invention can also be used, for example, in warehouse systems or automatic order-picking systems for comparable tasks, in which products or parts provided with codings are delivered to sorting containers or pigeonholes assigned to the respective codings.

The invention is based on the realization that conveyed item carriers comprising a fixedly arranged wall part and a movably arranged wall part can, in the closed position, also reliably receive conveyed items, such as for example thin letters, and in delivery permit a reliably controllable transfer of the conveyed item to an assigned sorting container or an assigned pigeonhole. Stopping or braking of the conveyed item carriers upon transfer of the conveyed item is not necessary in this case since the delivery chute adjoining the delivery slot and sloping counter to the transporting direction permits particularly dependable delivery right to the sorting container or pigeonhole assigned to the respective conveyed item. The inclination of the delivery chute and the speed of the conveyed item carrier can in this case be adapted to each other such that even a vertical drop of thin letters can be achieved.

An aspect of the invention the delivery chute is in this case preferably formed by the movable wall part. The center of gravity of the movable wall part is in this case shifted downward, thereby permitting automatic swiveling from the closed position into the delivery position without additional actuating means.

By providing the movably arranged wall part such that it can swivel about a pivot axis a particularly simple swiveling of the movable wall part between the closed position and delivery position of the conveyed item carrier results.

By holding the movably arranged wall part in a closed position by a releasable catch and an automatic swiveling into the delivery position after release of the catch, this ensures by the secured closed position a particularly dependable transport of the conveyed item. On the other hand, only minimal complexity is required for reliably assuming the delivery position.

By outwardly curving the fixedly arranged wall part and the movably arranged wall part, reliable receiving of different types and sizes of conveyed item results, a considerable reinforcing of the wall parts being achieved at the same time by the curvatures.

By providing the fixedly arranged wall part and the movably arranged wall part with the toothing intermeshing in the closed position, this ensures a particularly dependable transport of the conveyed item, since the intermeshing toothing prevents falling out of thin letters or the like even in the case of a not completely closed position.

By bending in a corrugated form the fixedly arranged wall part and the movably arranged wall part, this permits a further reinforcing of the wall parts, the corrugated configuration at the same time also preventing undesired sticking of thin letters or the like to the wall parts of the conveyed item carrier.

By fastening the conveyed item carriers in the region of an end face of the fixedly arranged wall part and of the movably arranged wall part on a circulating transport carriage of the conveying mechanism, this permits a laterally projecting arrangement of the conveyed item carriers on a circulating transport carriage, the conveyed item carriers also being able to be taken through between two rows of sorting containers arranged with a relatively small vertical distance in relation to each other. Also according to the invention, there are in this case preferably fastened on the transport carriages two or more conveyed item carriers, resulting in a further reduction in the constructional complexity of the overall conveying mechanism.

Also according to the invention, the conveyed item carriers are open at an end face opposite the transport carriage which permits a lateral loading of the conveyed item carriers, thereby allowing particularly small overall heights of the sorting installation to be realized.

By guiding the transport carriage by rollers on two profiles of the conveying mechanism which are aligned at a vertical distance in relation to each other and extending in the transporting direction, this, permits dependable guidance of the transport carriages with minimal constructional complexity. The profiles according to are also preferably being of a tubular design.

By connecting the two profiles to each other in the region of straight-running sections of the conveying mechanism by cross-pieces extending in a transporting direction, this permits a robust and reliable arrangement of the two profiles in the straight-running sections of the conveying mechanism, so that it is possible to dispense with additional fastening means for the profiles in the curved and deflecting regions of the conveying mechanism.

By fastening the transport carriage on an endlessly circulating transport cable of the conveying mechanism, this permits reliable and robust driving of the transport carriages with particularly little complexity.

By circulating the transport carriage on at least two levels via at least one height-overcoming deflecting structure, this makes it possible with the same area for setting up the overall sorting installation for example to double the sorting containers available for the sorting tasks. In this case, on each level the transport carriage is taken along in each case two parallel rows with sorting containers. The U-shaped deflecting means and height-overcoming deflecting means required for this purpose can in this case be realised particularly simply by the roller guidance of the transport carriages on two profiles and by the driving by means of a circulating transport cable.

An exemplary embodiment of the invention is described in more detail below and is represented in the drawings, in:

DESCRIPTION OF THE PREFERRED EMBODIMENTS

Figure 1:
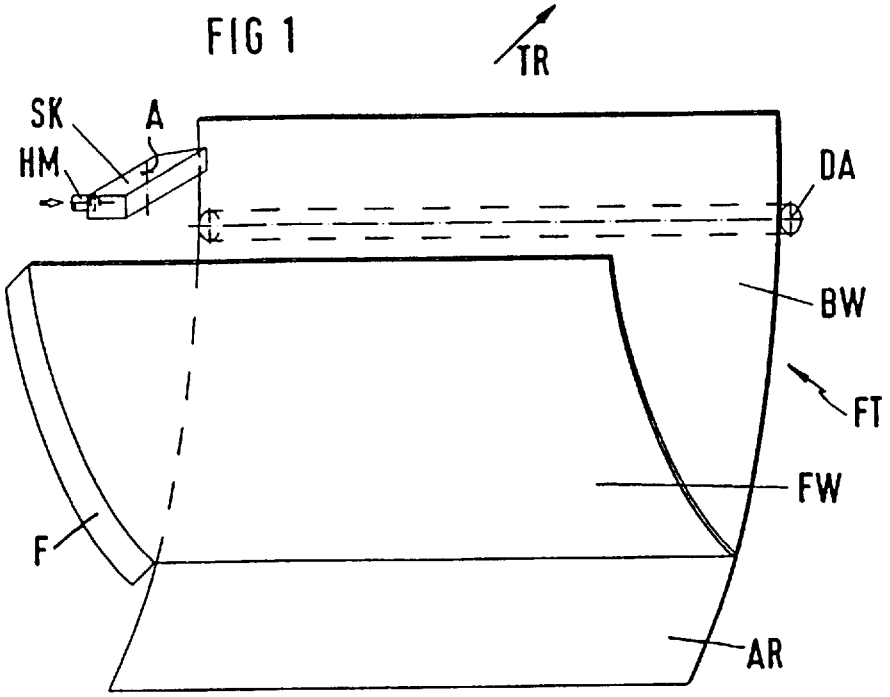
FIG. 1 shows in perspective representation a conveyed item carrier comprising a fixedly arranged wall part and a movably arranged wall part.

FIG. 1 shows in perspective representation a conveyed item carrier, which is denoted overall by FT and comprises a fixedly arranged wall part FW and a movable wall part BW. The movable wall part BW is in this case able to swivel about a pivot axis DA aligned transversely with respect to the transporting direction TR of the conveyed item carrier FT.

Figure 2:
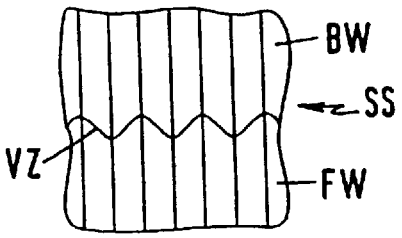
FIG. 2 shows the toothing of the two wall parts represented in FIG. 1, in the closed position of the conveyed item carrier.

FIG. 1 shows the closed position of the conveyed item carrier FT, in which the fixedly arranged wall part FW and the movably arranged wall part BW, which are both curved outward in each case, form a cross-sectionally approximately V-shaped receiving pocket for the conveyed item. According to FIG. 2, the two wall parts FW and BW are in each case bent in a corrugated form, the two wall parts FW and BW intermeshing with a toothing VZ in the closed position SS represented in a plan view from above. According to FIG. 1, the securement of the closed position SS takes place by a catch SK, which can be turned about an axis denoted by A and can be released by actuation of a solenoid HM. If the catch SK is released, the movable wall part BW is swiveled about the pivot axis DA such that a downwardly open delivery slot of the conveyed item carrier FT is formed. The lower extension of the movably arranged wall part BW in this case forms a delivery chute AR, which adjoins this delivery slot in the downward direction and slopes counter to the transporting direction TR.

Figure 3:
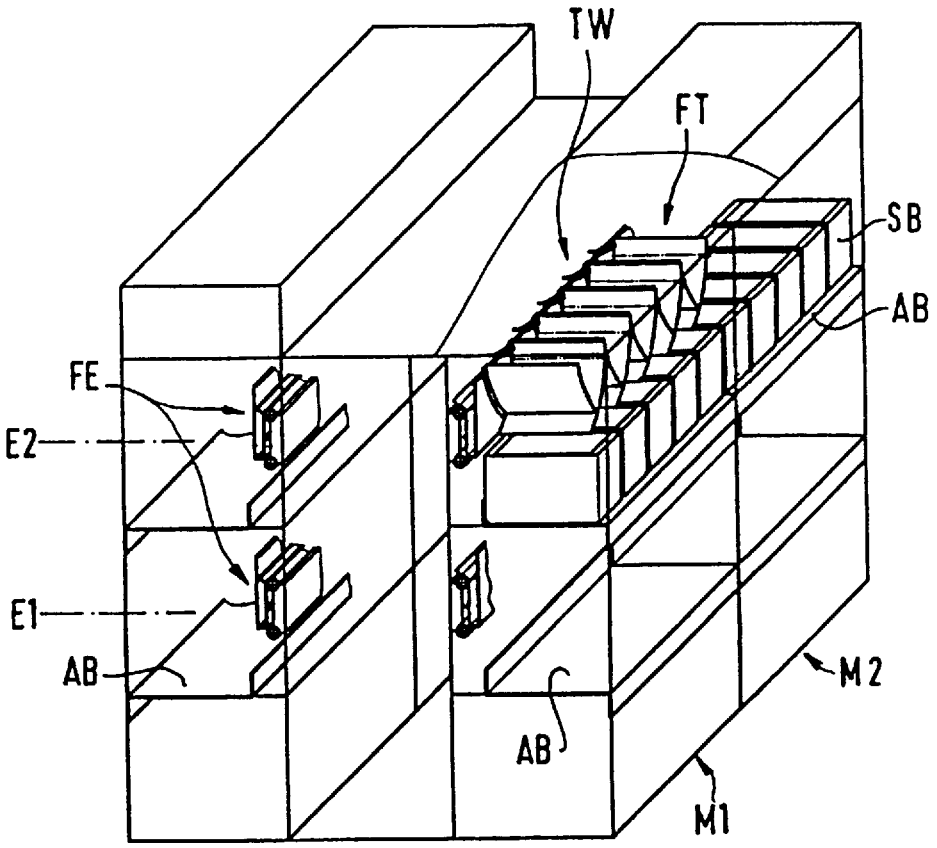
FIG. 3 shows a perspective representation of two modules, arranged in series, of a sorting installation equipped with conveyed item carriers according to FIG. 1.

FIG. 3 shows a perspective representation of two modules M1 and M2, arranged in series, of a sorting installation equipped with conveyed item carriers FT according to FIG. 1. Here there are in each case a total of five conveyed item carriers FT fitted on a transport carriage TW, which is a component part of a conveying mechanism FE and circulates on two levels E1 and E2. Each module M1 and M2 has on each level E1 and E2 in each case two support plates AB, onto which sorting containers SB can be placed in series closely next to one another. It can be seen that the conveyed item carriers FT on the transport carriages TW circulate over the sorting containers SB in such a way that, upon the actuation of the catch SK (compare FIG. 1). the conveyed item, not represented in any more detail in FIG. 3, can be dropped into a sorting container SB assigned to the respective coding.

Figure 4:
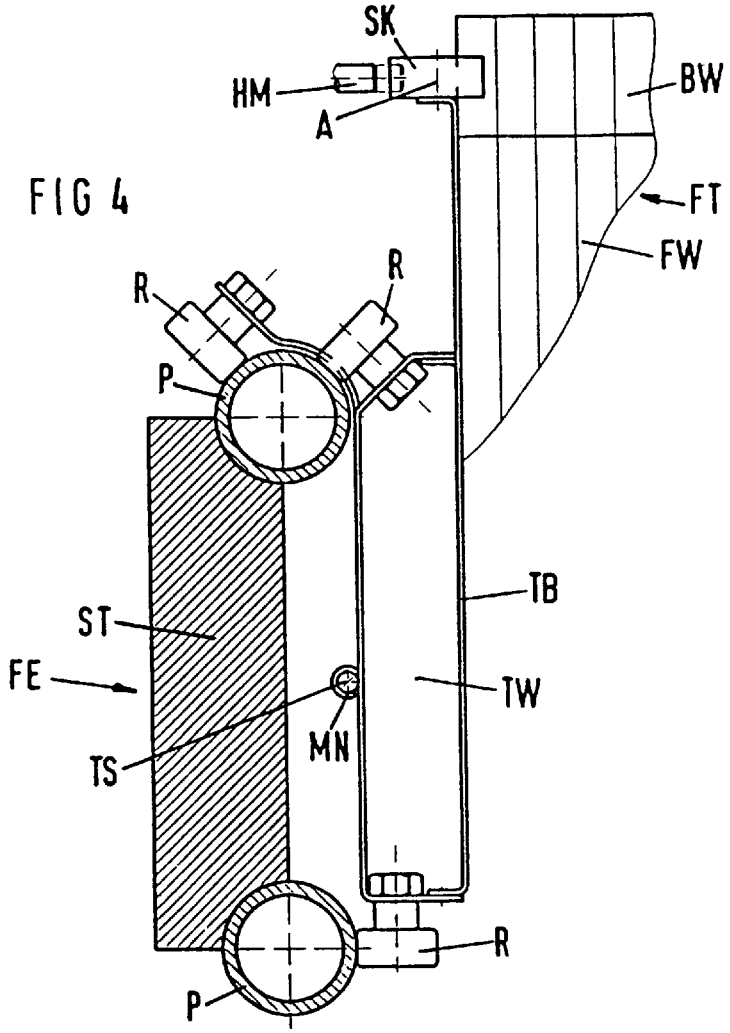
FIG. 4 shows the operating principle of the conveying mechanism used in the sorting installation according to FIG. 2.

FIG. 4 shows more details of the conveying mechanism FE represented in FIG. 3. In the cross section represented here, it can be seen that the transport carriage TW is guided by means of rollers, denoted by R, on two tubular profiles P, extending in the transporting direction TR (compare FIG. 1). The profiles P, aligned parallel to each other a vertical distance apart, are in this case connected to each other in straight-running regions of the conveying mechanism FE by means of cross-pieces ST, likewise extending in the transporting direction TR, whereas these cross-pieces ST are dispensed with in the curved regions. The driving of a transport carriage TW takes place by means of an endlessly circulating transport cable TS, to which the transport carriage TW is fastened with the aid of a driver MN. On the side opposite the transport cable TS, the transport carriage TW has a carrying plate TB, on which the individual conveyed item carriers FT are fastened at the end face and which also bears the catches SK and the assigned solenoids HM. The carrying plate TB in this case acts as a securing means for the pivot axes DA of the movable wall parts BW, while the fix wall parts FW of the individual conveyed item carriers FT are fixedly connected to the carrying plate TB by means of flanges F on the end face (compare FIG. 1).

Figure 5:
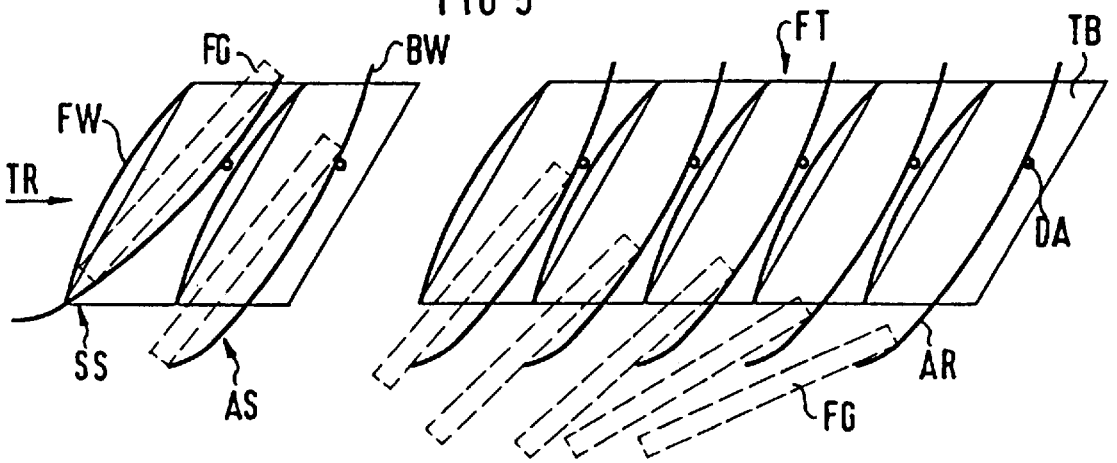
FIG. 5 shows a study of the sequence of movements of the conveyed item when dropping from a conveyed item carrier according to FIG. 1.

FIG. 5 shows a study of the time-independent sequence of movements when dropping the conveyed item from the conveyed item carriers FT according to the invention. On the left-hand side of the representation shown here, a conveyed item carrier FT can be seen in its closed position SS. The conveyed item FG, represented by dashed lines, is intended here to be a thin letter.

The second conveyed item carrier FT, seen from the left, is represented already in its delivery position AS, in which, by a pivoting about the pivot axis DA, the movable wall part BW forms together with the fixedly arranged wall part FW a delivery slot for the conveyed item FG. It can be seen from the following positions of the conveyed item FG that the latter slides downward over the delivery chute AR and as it does so receives in addition to the downwardly directed vertical component of motion a horizontal component of motion opposed to the transporting direction TR. In this case, the transporting speed in the transporting direction TR and the inclination of the delivery chute AR can be adapted to each other such that the conveyed item FG can fall at least largely vertically downward into an assigned sorting container SB (compare FIG. 3).

Figure 6:
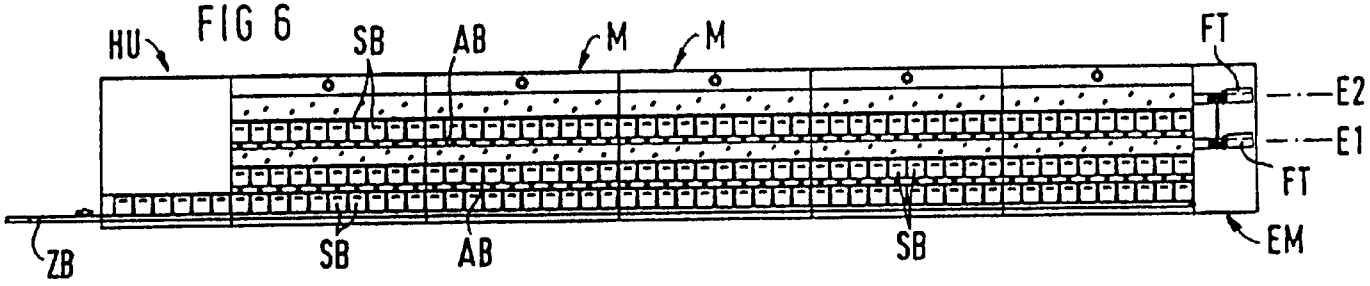
FIG. 6 shows a side view of a sorting installation constructed from modules according to FIG. 3.
Figure 7:
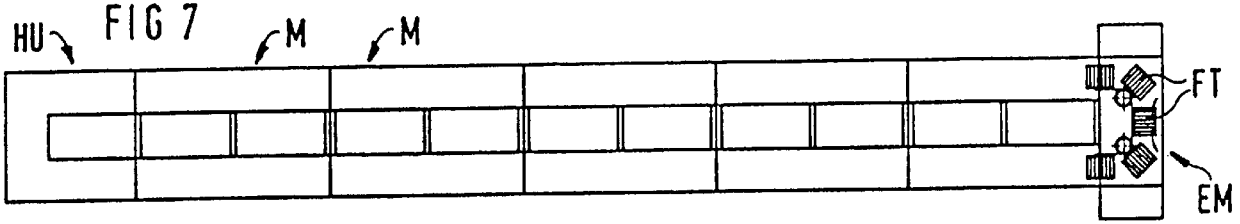
FIG. 7 shows a plan view of the sorting installation according to FIG. 6.

FIGS. 6 and 7 show a sorting installation made up of individual modules M in side view and in plan view, respectively. The individual modules M correspond in this case to the modules M1 and M2 represented in FIG. 3, there also being shown, however, in FIG. 6 an additional feeding belt ZB, arranged underneath the lower level E1, for the provision of empty sorting containers SB. When a full sorting container SB is removed from the level E1 or the level E2, it can be replaced by an empty sorting container SB provided on the feeding belt ZB.

In the case of the representation according to FIGS. 6 and 7, there is on the left-hand side in front of the first module M a height-overcoming deflecting means HU, while on the right-hand side there adjoins the last module M a loading module EM at the end face. It can be seen that, in the region of this loading module EM, the individual conveyed item carriers FT can be loaded from the rear side, from the end face, or from the front side, it being possible for the loading to be performed manually or by machine.

Figure 8:
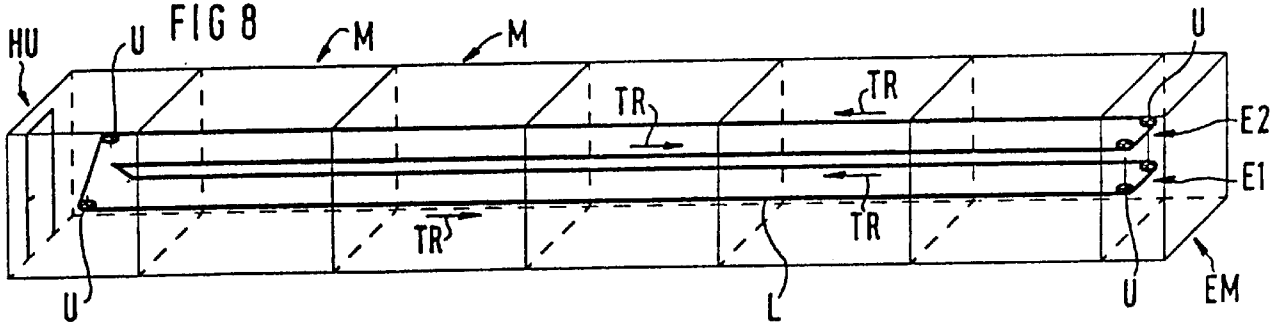
FIG. 8 shows a perspective representation of the guidance of the conveying mechanism of the sorting installation represented in FIGS. 6 and 7, over two levels.

FIG. 8 shows in a greatly simplified schematic representation the routing of the conveying mechanism FE (compare FIGS. 3 and 4) over the two levels E1 and E2. The line L in this case shows the spatial path of the transport cable TS (compare FIG. 4), the transporting direction being indicated by arrows TR. The guidance of the transport cable TS in the region of the height-overcoming deflecting means HU and in the region of the loading module EM is in this case indicated by deflecting rollers U. The corresponding spatial path of the profiles P (compare FIG. 4), taken parallel to the line L, cannot be seen in FIG. 3.

The conveyed item carriers FT, loaded with conveyed items FG for example in a rearward loading zone of the lower level E1 (compare FIG. 7), are deflected forward on the same level in the region of the end face of the loading module EM and then transported past the sorting containers SB arranged on the front side on the lower support plate AB. In the region of the height-overcoming deflecting means HU, the conveyed item carriers FT are then taken obliquely upward onto the upper level E2 and there they are transported past the sorting containers SB arranged on the rear side on the upper support plate AB. In the region of the loading module EM, the conveyed item carriers FT are then deflected forward on the same level and are then transported past the sorting containers SB arranged on the front side on the upper support plate. In the region of the height-overcoming deflecting means HU, the conveyed item carriers FT are then taken obliquely downward onto the lower level E1 and there they are transported past the sorting containers SB arranged on the rear side on the lower support plate AB. On the transporting path described above, the individual conveyed item carriers FT deliver the taken-along conveyed item FG to an assigned sorting container SB, so that they can then be loaded again with conveyed items FG when passing the rear loading zone.

Although various minor changes and modifications might be proposed by those skilled in the art, it will be understood that our wish is to include within the claims of the patent warranted hereon all such changes and modifications as reasonably come within our contribution to the art.

What is claimed is:

1. A sorting installation for mail, comprising:

a plurality of conveyed item carriers circulating on at least one conveying mechanism for receiving, transporting and controllably delivering conveyed items;

each conveyed item carrier comprising a fixedly arranged wall part and a movably arranged wall part;

the movably arranged wall part forming in a closed position together with the fixedly arranged wall part a cross-sectionally approximately V-shaped receiving pocket for the conveyed item;

the movably arranged wall part forming in a delivery position together with the fixedly arranged wall part a downwardly open delivery slot for the conveyed items;

one of the two wall parts forming a delivery chute adjoining the delivery slot in a downward direction and sloping counter to a transporting direction and having a curved section for imparting a horizontal velocity to the conveyed items to at least partially compensate for a horizontal velocity of the item carrier in the transport direction; and the curved section extending substantially below where said fixedly arranged wall part and moveably arranged wall part meet in a closed position at a bottom of the V-shaped receiving pocket.

2. The sorting installation according to claim 1 wherein the delivery chute is formed by the movable wall part.

3. The sorting installation according to claim 1 wherein the movably arranged wall part is arranged such that it can swivel about a pivot axis aligned transversely with respect to the transporting direction.

4. The sorting installation according to claim 1 wherein the movably arranged wall part is held in the closed position by a releasable catch and swivels automatically into the delivery position after release of the catch.

5. The sorting installation according to claim 1 wherein the fixedly arranged wall part and the movably arranged wall part are curved outwardly in each case.

6. The sorting installation according to claim 1 wherein the fixedly arranged wall part and the movably arranged wall part have a toothing intermeshing in a closed position.

7. The sorting installation according to claim 1 wherein the fixedly arranged wall part and the movably arranged wall part are bent in a corrugated form.

8. The sorting installation according to claim 1 wherein the conveyed item carriers are fastened in a region of an end face of the fixedly arranged wall part and of the movably arranged wall part on a circulating transport carriage of the conveying mechanism.

9. The sorting installation according to claim 8 wherein on a transport carriage there are fastened at least two of said conveyed item carriers.

10. The sorting installation according to claim 8 wherein the conveyed item carriers are open at an end face opposite the transport carriage.

11. The sorting installation according to claim 8 wherein the transport carriage is guided by rollers on two profiles of the conveying mechanism which are aligned at a vertical distance in relation to each other and extend in the transporting direction.

12. The sorting installation according to claim 11 wherein the profiles are of a tubular design.

13. The sorting installation according to claim 11 wherein the two profiles are connected to each other in a region of straight-running sections of the conveying mechanism by cross-pieces extending in the transporting direction.

14. The sorting installation according to claim 8 wherein the transport carriage is fastened on an endlessly circulating transport cable of the conveying mechanism.

15. The sorting installation according to claim 1 wherein the curved section has a curvature and a length chosen such that said horizontal velocity imparted to the conveyed items substantially completely compensates for said horizontal velocity of the item carrier in the transport direction so that the conveyed items fall substantially vertically without any substantial horizontal velocity component.

* * * * *